US010870992B2

(12) United States Patent
Pfaff

(10) Patent No.: US 10,870,992 B2
(45) Date of Patent: Dec. 22, 2020

(54) REINFORCEMENT ARRANGEMENT AND METHOD FOR PRODUCING A CONSTRUCTION MATERIAL BODY USING THE REINFORCEMENT ARRANGEMENT

(71) Applicant: Solidian GmbH, Albstadt (DE)

(72) Inventor: Johann Pfaff, Winterlingen (DE)

(73) Assignee: Solidian GmbH, Albstadt (DE)

( * ) Notice: Subject to any disclaimer, the term of this patent is extended or adjusted under 35 U.S.C. 154(b) by 0 days.

(21) Appl. No.: 16/388,298

(22) Filed: Apr. 18, 2019

(65) Prior Publication Data

US 2019/0323239 A1 Oct. 24, 2019

(30) Foreign Application Priority Data

Apr. 20, 2018 (EP) ..... 18168499

(51) Int. Cl.
*E04C 5/20* (2006.01)
*B28B 23/00* (2006.01)
(Continued)

(52) U.S. Cl.
CPC ..... *E04C 5/205* (2013.01); *B28B 23/00* (2013.01); *E04C 5/073* (2013.01); *E04C 5/166* (2013.01);
(Continued)

(58) Field of Classification Search
CPC ..... E04C 5/205; E04C 5/073; E04C 5/166; E04C 5/07; E04C 5/168; E04C 5/0627; E04C 5/064; E04C 2/288; B28B 23/00
(Continued)

(56) References Cited

U.S. PATENT DOCUMENTS 3,559,355 A 2/1971 Day, Jr.
3,744,207 A * 7/1973 Oroschakoff ..... B21F 27/121 52/664
(Continued)

FOREIGN PATENT DOCUMENTS

DE 202012010850 U1 7/2013
DE 102016210040 A1 12/2017
(Continued)

OTHER PUBLICATIONS

Extended European Search Report, dated Oct. 30, 2018 for European Application No. 18168499.4 (9 pgs.).
(Continued)

*Primary Examiner* — Brent W Herring
(74) *Attorney, Agent, or Firm* — Fitch, Even, Tabin & Flannery LLP

(57) ABSTRACT

A reinforcement arrangement and a method for producing a construction material body using the reinforcement arrangement. The reinforcement arrangement comprises a reinforcement body and at least one holding anchor unit. Each holding anchor unit is arranged or attached at the reinforcement body by a foot section. A holding section adjoining the foot section is moveable between a storage position and a function position. In the storage position, the holding section extends directly adjacent along the reinforcement body and abuts the reinforcement body at one or more locations. In the function position, a free end of the holding section opposite the foot section is larger than in the storage position. The holding section can be moved manually or self-acting from the storage position into the function position. The reinforcement body, the holding section, and the foot section are preferably embodied as textile-reinforced elements.

13 Claims, 4 Drawing Sheets

(51) Int. Cl.
*E04C 5/06* (2006.01)
*E04C 5/07* (2006.01)
*E04C 5/16* (2006.01)

(52) U.S. Cl.
CPC ..... *E04C 5/168* (2013.01); *E04C 5/064* (2013.01); *E04C 5/0627* (2013.01)

(58) Field of Classification Search
USPC .. 52/231, 648.1, 649.1, 649.3, 649.5, 649.7, 52/649.8, 719; 138/174, 175, 176
See application file for complete search history.

(56) References Cited

U.S. PATENT DOCUMENTS 3,815,642 A * 6/1974 Henry ..... F16L 9/08 138/175
3,840,054 A 10/1974 Tolliver
3,857,416 A * 12/1974 Borodin ..... E04C 5/0613 138/175
4,452,026 A * 6/1984 Tolliver ..... E04C 5/18 52/684
5,616,272 A * 4/1997 McCrystal ..... E04C 5/162 249/207
5,924,458 A * 7/1999 Kaines ..... B21F 15/06 138/172
6,115,987 A * 9/2000 Tatum ..... E04C 5/18 52/684
6,247,501 B1 * 6/2001 Kaines ..... E04C 5/0613 138/172
8,367,569 B2 * 2/2013 Wheatley ..... C04B 28/02 442/312
8,769,906 B2 * 7/2014 Standal ..... E04C 5/04 52/649.5
10,450,749 B2 * 10/2019 Render ..... E04C 5/166
2006/0137282 A1 * 6/2006 Anvick ..... E04C 5/04 52/649.1
2007/0272353 A1 * 11/2007 Wheatley ..... E01D 19/00 156/304.3
2009/0081913 A1 * 3/2009 Wheatley ..... D03D 9/00 442/103
2009/0263572 A1 * 10/2009 Wheatley ..... C04B 28/02 427/136
2013/0047545 A1 2/2013 Standal
2018/0171635 A1 * 6/2018 Render ..... E04C 5/0604

FOREIGN PATENT DOCUMENTS

FR 2203312 A5 5/1974
GB 2539709 A 12/2016
WO 2015/097377 A1 7/2015

OTHER PUBLICATIONS

European Office Action dated Jun. 22, 2020, in corresponding European Application No. 18168499.4, with machine English translation (7 pages).

* cited by examiner

REINFORCEMENT ARRANGEMENT AND METHOD FOR PRODUCING A CONSTRUCTION MATERIAL BODY USING THE REINFORCEMENT ARRANGEMENT

RELATED APPLICATION(S)

This application claims the benefit of European Patent Application No. 18168499.4, filed Apr. 20, 2018, the contents of which are incorporated herein by reference as if fully rewritten herein.

TECHNICAL FIELD

The invention refers to a reinforcement arrangement for a construction material body and to a method for producing the construction material body using the reinforcement arrangement.

BACKGROUND

Construction material bodies are amongst others produced in several courses or layers or in sandwich structure. Such a construction material body comprises a construction material layer that has a supporting function. As construction material concrete or mortar can be used. On this construction material layer is applied, particularly for insulation. This intermediate layer is subsequently covered by a further outer layer, which is called facing. The intermediate layer is regularly able to support no or only low forces. Therefore, anchors are inserted in the supporting construction material layer that pass through the intermediate layer and connect the supporting construction material layer with the outer layer or facing. The production of such a sandwich construction material body is elaborate. Usually the connection anchors have to be manually put and orientated in the formwork when pouring the construction material layer, at which connection anchors the outer layer or facing is attached in a later stage. Such sandwich plate anchor systems are, for example offered by Philipp GmbH (www.philipp-gruppe.de).

The object of the present invention can therefore be considered that of providing a reinforcement arrangement that allows simple production of a construction material body in sandwich structure.

SUMMARY

This object is solved by means of a reinforcement arrangement and method according to the features described below.

The inventive reinforcement arrangement comprises crossing reinforcement elements that are connected with each other and form a reinforcing body. The reinforcing body is configured to reinforce a construction material layer of a construction material body to be produced and to particularly support tension forces in extension direction of the reinforcement elements. In one embodiment the reinforcement body can be embodied as reinforcement grid that extends substantially parallel to a plane.

Preferably the reinforcement body is embodied as textile reinforcement and comprises fiber bundles, wherein the fibers of a fiber bundle are connected by a matrix. The matrix can consist of a synthetic material or a mineral material. The reinforcement body is preferably free of metallic components.

A holding anchor unit is arranged at the reinforcing body. The holding anchor unit has a foot section and a holding section joining the foot section preferably in an integral manner. The holding anchor unit is attached to the reinforcing body by means of the foot section. The mounting between the foot section and the reinforcing body can be realized in a force-fit and/or form-fit manner and appropriate mounting means can be used, such as cable ties, mounting clips or the like.

The holding section can be moved between a function position and a storage position. Therefore, the holding section is movably supported together with the foot section at the reinforcing body and/or the holding section is moveably supported at the foot section. In the storing position the holding section extends along the reinforcing body. This means a position of the holding section, in which the holding section either abuts against the reinforcing body or is arranged parallel therewith at low distance or extends under an angle of at most 5, at most 10 or at most 20 degrees inclined relative to the reinforcing body. In the storage position the holding section is thus arranged closely to the reinforcing body and has a maximum distance of at most 2 to 3 cm or at most 5 cm from the reinforcing body.

The movement of the holding section in the function position can, for example be made by means of a pivot movement. In the function position the holding section extends transverse (inclined or orthogonally) away from the reinforcement body, wherein an angle between the holding section and the reinforcement body has preferably an amount of at least 30 degrees up to 90 degrees. In the function position the holding section takes a position, in which it can be molded into a construction material layer when producing a construction material body.

The reinforcement arrangement thus already comprises at least one holding anchor unit. Prior or after the arrangement of the reinforcement arrangement into a formwork only the at least one holding section must be moved in the function position. The movement in the function position can be carried out manually or automatically or self-acting. For the self-acting movement into the function position the holding section of the at least one anchor unit can be urged in direction toward the function position by means of a pretensioning force and/or a pretensioning torque, for example. The position and/or orientation of the holding section in the function position can be structurally predefined, for example by means of a mechanical stop and/or the pretensioning force and/or the pretensioning torque. The reinforcement arrangement can be prefabricated. An elaborate arrangement and orientation of separate anchors at the reinforcement body after arranging the reinforcement body into the formwork is not necessary at the construction site or at the plant.

Preferably the holding anchor units are arranged in a predefined grid dimension or distance relative to each other that complies with a standard size of bodies or plates, that are used as intermediate layer when producing the sandwich construction material body, such that the holding sections pass along abutment locations between two bodies or plates of the intermediate layer and can create a connection between an inner, supporting construction material layer and an outer layer or facing.

Preferably each reinforcing element comprises at least one fiber bundle that is embedded in a matrix. The reinforcing element is thus embodied as textile reinforcement element. The reinforcement element is preferably free of metallic components.

In one preferred embodiment the at least one holding anchor unit is subject to a pretensioning force and/or a pretensioning torque in the storage position. The pretensioning force and/or the pretensioning torque are orientated, such that the holding section is urged toward the function position. Thus, a self-acting setting of the function position can be achieved, if the holding section is not maintained in its storage position due to applied outer forces. For example, the pretensioning force can be created by a separate pretensioning means and/or by the foot section and/or the holding section itself. For example, a torsion force can be created in the region of the foot section, if the holding section is in its storage position, wherein the torsion force forms the pretensioning force and urges the holding section in direction toward the function position.

It is further advantageous, if each holding anchor unit comprises two holding anchors and particularly exactly two holding anchors. Each holding anchor has a foot part and a holding part that extends orthogonally or inclined relative to the foot part. Between the foot part and the holding part a kink or bend can be formed. Preferably the foot part and the holding part form an angle in the region of 70 degrees to 120 degrees and more preferably an approximately right angle. Each holding anchor is directly or indirectly arranged at the reinforcement body by its foot parts. The foot parts of two holding anchors can thus form the holding section of the holding anchor unit. The holding parts of the holding anchors can form the holding section of the holding anchor unit. In so doing, it is particularly advantageous, if each holding anchor is formed integrally without seam or joint location.

Each holding anchor can comprise at least one fiber bundle that is embedded in a matrix of synthetic material or mineral material. The holding anchor can thus have the similar structure as the reinforcement elements. Preferably each holding anchor is free of metallic components. It is further preferred, if each holding anchor unit is free of metallic components.

In one embodiment the holding part of each holding anchor is pivoted around a pivot axis. The pivot axis is particularly also defined by the direction, in which the foot part of the same holding anchor extends. Thus, the holding part can pivot mainly around the longitudinal axis of the foot part, if it moves between the storage position and the function position. For that purpose the foot part can be twisted and/or rotatably mounted at the reinforcement body.

It is further advantageous, if the foot parts of the holding anchor of the same holding unit extend in the same plane and/or if the holding parts of the holding anchors of the same holding anchor unit are arranged substantially in a common plane in the storage position, wherein in their storage position the holding parts can be arranged in the plane of the foot parts.

It is further advantageous, if an angle between the foot parts of holding anchors of the same holding anchor unit is smaller than 180 degrees. This angle can amount to at least 90 degrees in one embodiment. In so doing, the relative orientation and/or the relative distance between the holding parts can change, if the holding parts are moved from the function position into the storage position. This change of the relative orientation and/or the relative distance can be used for creating or changing a pretensioning force and/or a pretensioning torque that urges the holding part of the holding anchors into the function position. For example a pretensioning means can be connected with the holding parts. Particularly the pretensioning means can be elastically deformable and/or causes an elastic deformation of the holding parts, if they are in the storage position. The pretensioning force created by the pretensioning means can change depending on the elastic deformation of the pretensioning means, such that a change of the relative distance can be used for creating the pretensioning force.

Any embodiment of the above-discussed reinforcement arrangement can be used for producing a construction material body as follows:

First, the reinforcement body is arranged in a formwork and the holding section of the at least one holding anchor unit is moved into the function position. This can occur self-acting or can be executed manually.

Subsequently, a curable construction material, for example concrete or mortar is filled into the formwork, such that the reinforcement body is covered by a construction material layer. The at least one holding section extends at least partly out of the construction material layer. The at least one foot section is preferably completely covered by the construction material layer. The construction material layer subsequently forms a supporting layer of the construction material body.

Subsequently, an intermediate layer is arranged on the construction material layer, preferably before the construction material layer is cured. The intermediate layer can be an insulation layer. The intermediate layer preferably comprises a plurality of bodies or plates. Usually the grid dimension of these bodies or plates is known, such that the position of the at least one holding anchor unit at the reinforcement body can be selected such that the at least one holding section passes through two adjacent bodies or plates in the area of an abutment location. In so doing, trimming or cutting or adapting of the bodies or plates can be omitted.

Subsequently, a further construction material layer can be applied onto the intermediate layer, for example also by filling a curable construction material (e.g. concrete or mortar) in the formwork. This further construction material layer is connected with the at least one holding section or the end thereof, that extends out of the intermediate layer. This further construction material layer forms a facing and is thus connected by means of the at least one holding section with the supporting construction material layer. The construction materials of the supporting construction material layer and the outer layer can be different. The construction material body can be named as sandwich construction material body, due to its layered structure.

BRIEF DESCRIPTION OF THE DRAWINGS

Advantageous embodiments of the invention will become clear from the dependent claims, the description and the drawings. Embodiments of the invention will be explained in greater detail hereinafter with reference to the accompanying drawings, in which:

DETAILED DESCRIPTION

Figure 1:
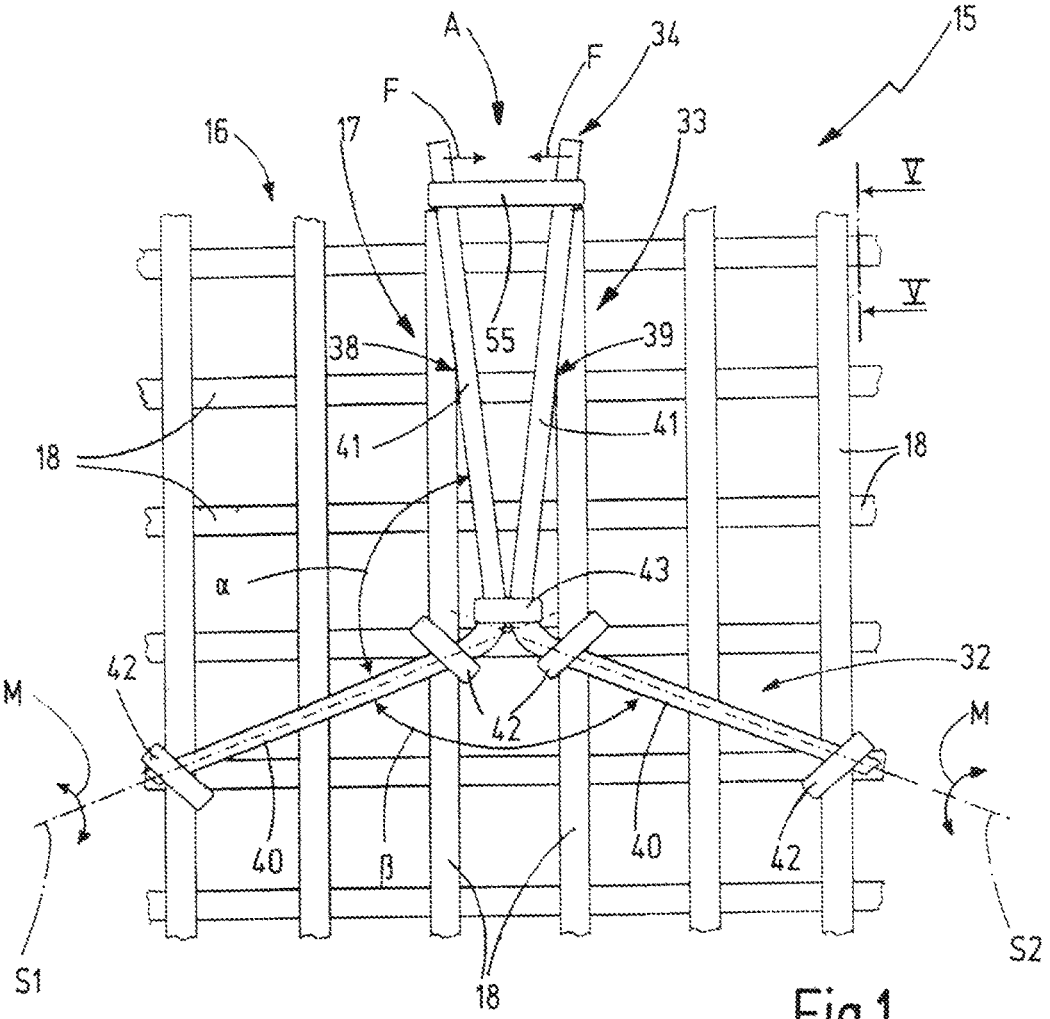
FIG. 1 shows a schematic partial illustration of an embodiment of a reinforcement arrangement with a portion of a reinforcement body and one holding anchor unit arranged thereon, the holding section of which is in a storage position.

FIGS. 1-4 and 9 each illustrate a first embodiment of a reinforcement arrangement 15. The reinforcement arrangement 15 comprises a reinforcement body 16 and at least one holding anchor unit 17 arranged at the reinforcement body 16. The reinforcement body 16 has a plurality of crossing reinforcement elements 18 that are connected with each other. The reinforcement elements 18 are formed by a fiber bundle with a plurality of fibers 19 (so-called rovings) that are arranged or embedded in a matrix 20, according to the example. The matrix 20 consists preferably of synthetic material and can alternatively also consist of a mineral material. By curing the matrix 20, the reinforcement elements form reinforcement rods. The reinforcement elements 18 are configured to support a tension force, in order to reinforce the construction material body 21 (FIG. 9) that is to be produced. The reinforcement elements 18 are connected with each other at connecting or crossing locations and thus form the reinforcement body 16.

In the illustrated embodiment the reinforcement body 16 is embodied as a reinforcement grid that extends substantially parallel to a plane. The reinforcement grid can also be named as reinforcement mat. Different thereto the reinforcement body 16 can form arbitrary other two-dimensional or three-dimensional reinforcement structures. The reinforcement body 16 can have an arbitrary form. In principle the reinforcement body 16 can be formed in any shape that can be created by means of the reinforcement elements 18. In so doing, the reinforcement elements 18 do not have to extend linearly, but can also have at least one kink or bend location.

The reinforcement body 16 is embodied as textile reinforcement according to the embodiment and does not contain metallic components.

Figure 9:
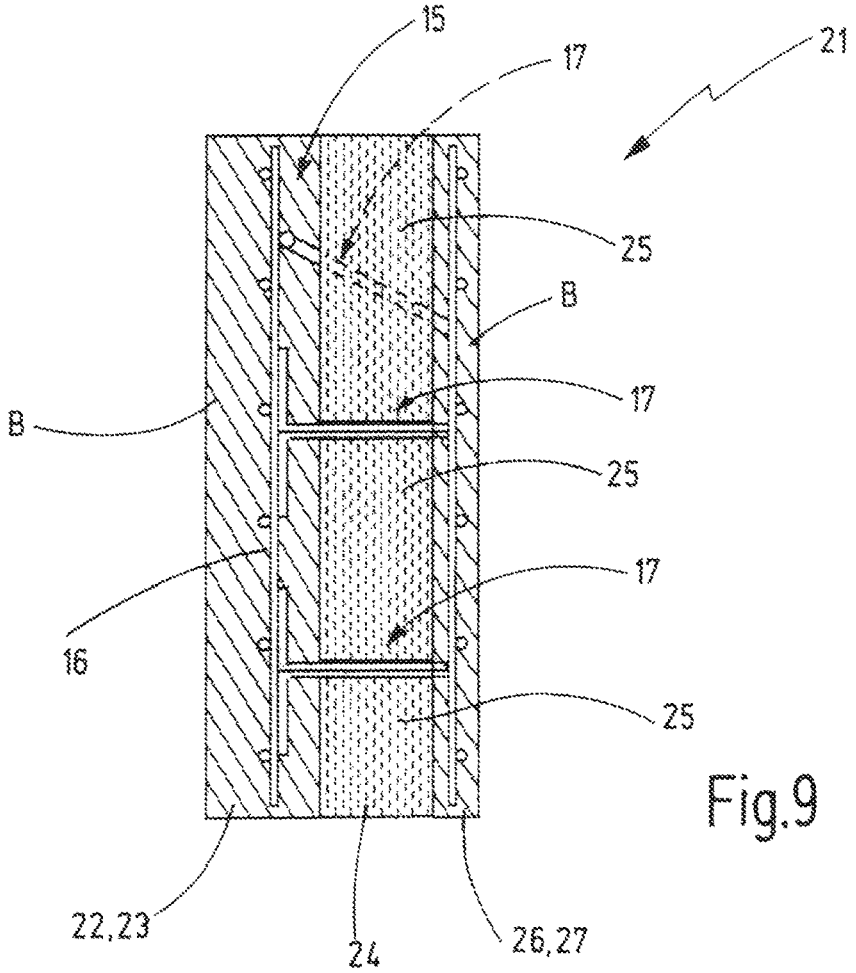
FIG. 9 shows a schematic cross-section view of a construction material body with a plurality of courses or layers that comprise a reinforcement arrangement with a plurality of holding anchor units and FIG. 10 shows a schematic basic illustration of an intermediate layer of the construction material body of FIG. 10 in a top view onto an outer side, with holding sections of the holding anchor units that pass through abutment locations between individual bodies or plates of the intermediate layer.
Figure 10:
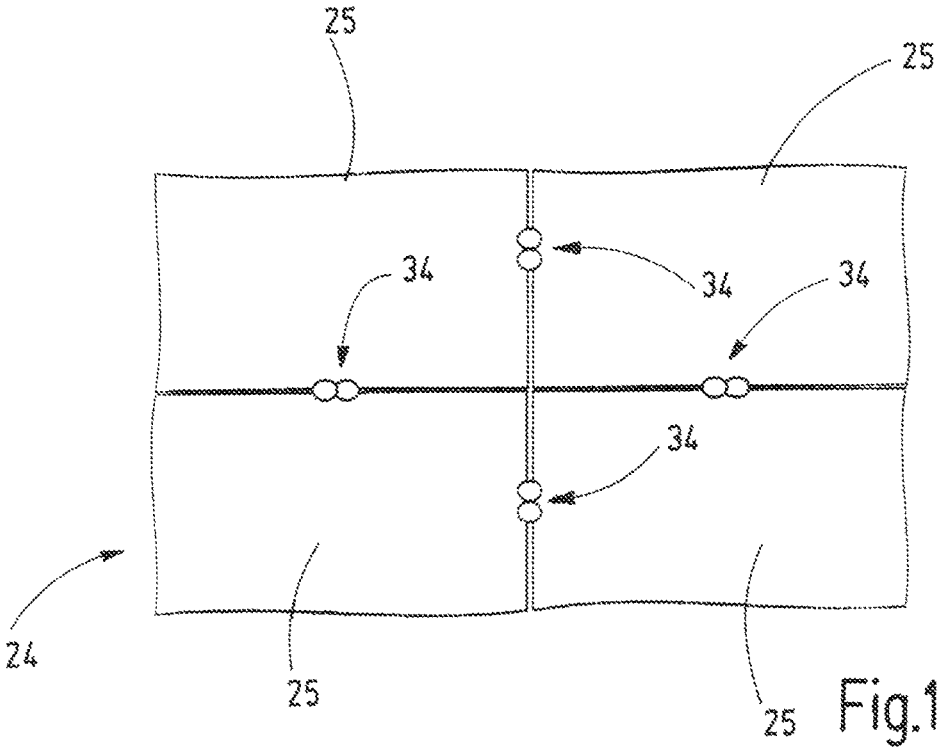

FIG. 9 illustrates a construction material body 21 that is structured with a plurality of layers and can thus be named a sandwich construction material body. The construction material body 21 has a supporting layer 22 that is formed from a construction material B that surrounds the reinforcement body 16 of the reinforcement arrangement 15. The supporting layer 22 can thus also be named as a first construction material layer 23. Adjoining to the first construction material layer 23 is an intermediate layer 24. The intermediate layer 24 is embodies as insulation layer according to the example and consists preferably of a plurality of bodies 25 or plates that are arranged within the intermediate layer 24 adjacent to one another and preferably abut against each other (FIG. 10). The bodies 25 of the intermediate layer 24 can be connected with each other at the abutment locations between two adjacent bodies 25 by an adhesive. At the abutment locations between two adjacent bodies 25 parts of the holding anchor unit 17 pass through and extend into an outer layer 26. The outer layer 26 can be produced similarly to the supporting layer 22 of the same or a different construction material B and can thus form a second construction material layer 27. The outer layer 26 can also be named a facing. As construction material B concrete or mortar can be used, for example.

A connection between the supporting layer 22 and the outer layer 26 is created by the at least one holding anchor unit 17, such that loads of forces that act upon the outer layer 26 can be transferred into the supporting layer 22 and supported there by means of the at least one holding anchor unit 17 and the reinforcement arrangement 15 respectively.

Each holding anchor unit 17 has a foot section 32 that is configured to arrange or attach the holding anchor unit 17 at the reinforcement body 16. Each holding anchor unit 17 comprises additionally a holding section 33 that is connected with the foot section 32. The holding section 33 of the holding anchor unit 17 extends obliquely or orthogonally away from the foot section 32 to a free end 34.

The holding section 33 is moveable between a storage position A (FIGS. 1 and 2) and a function position W (FIGS. 3, 4, 7 and 9). According to the example, the holding section 33 is pivotable between the storage position A and the function position W.

In the storage position A the holding section 33 of the holding anchor unit 17 has a position, in which it extends along the reinforcement body 16 and abuts against the reinforcement body 16 or against at least one reinforcement element 18 and/or extends substantially parallel or slightly inclined adjacent to the reinforcement body 16. Preferably the holding section 33 lies as close as possible and as flat as possible against the reinforcement body 16, if it is in its storage position A. The holding section 33 and particularly its free end 34 have a distance from the reinforcement body 16 in the storage position A of, for example 2 to 3 cm.

In the function position W the holding section 33 extends orthogonally or obliquely away from a plane, preferably with an angle of at least 30 to 45 degrees that is defined by the section of the reinforcement body 16, at which the holding anchor unit 17 is arranged or attached with its foot section 32.

The free end 34 of the holding section 33 is in the function position W arranged with a remarkably higher distance to the reinforcement body 16, as in the storage position A. The maximum distance of the free end 34 to the reinforcement body 16 is defined in the function position W by the length of the holding section 33 between the foot section 32 and the free end 34 and the orientation angle that the holding section 33 occupies relative to the reinforcement body 16 in the function position W. The orientation angle can be predefined depending from the loads (wind load, collapse load) that have to be supported. The reinforcement arrangement 15 can have holding anchor units 17 with different orientation angles (FIG. 9). For example, the orientation angle can have approximately 90 degrees or be in a range from 30 degrees to 50 degrees.

In the illustrated embodiments each holding anchor unit 17 has a first holding anchor 38 and a second holding anchor 39. Preferably the two holding anchors 38, 39 are embodied identically. Each holding anchor 38, 39 has a foot part 40 and a holding part 41 adjoining the foot part 40. The foot part 40 and the holding part 41 are embodied preferably integrally without seam and joint location. Between the foot part 40 and the holding part 41 a bend location or kink location is present. Between the holding part 41 and the foot part 40 of a holding anchor 38 or 39 respectively, a kink or bend angle is thus included, that is in the embodiment in the range between 70 degrees and 110 degrees and preferably between 80 degrees and 100 degrees (FIG. 1). The bend angle α is the angle between the holding part 41 and the foot part 40 without action of an outer force. Due to an elastic deformation of the holding anchor 38 or 39 respectively, the angle between the holding part 41 and the foot part 40 can change.

Figure 2:
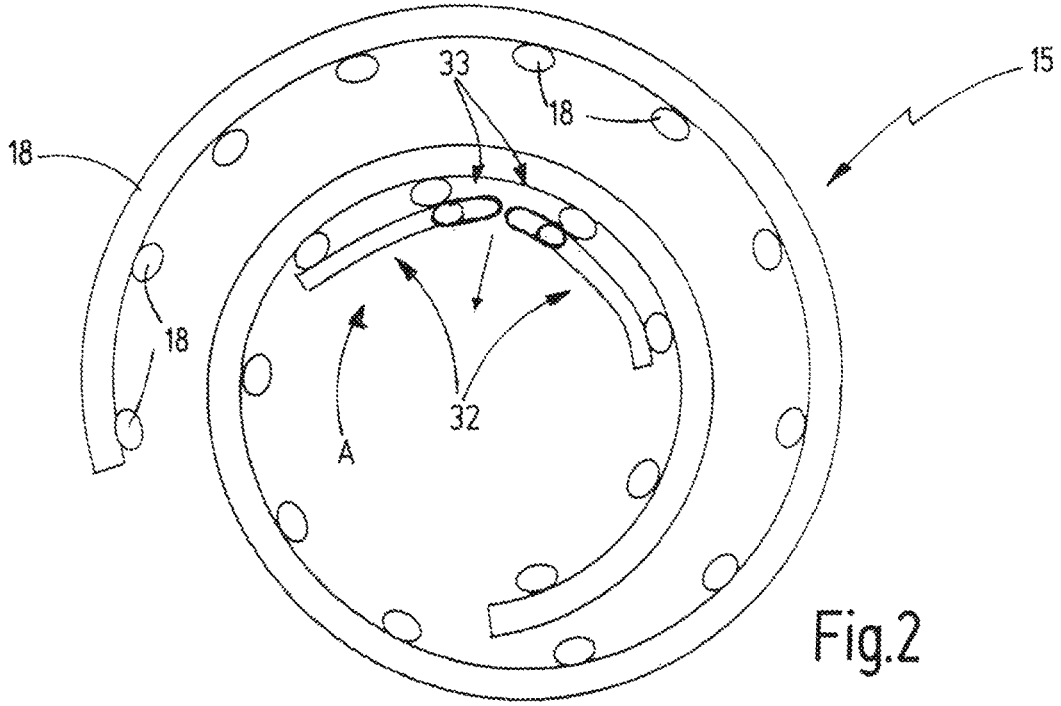
FIG. 2 shows the embodiment of the reinforcement arrangement according to FIG. 1, wherein the reinforcement body is rolled up for storage and the holding section of the holding anchor unit is in the storage position.
Figure 3:
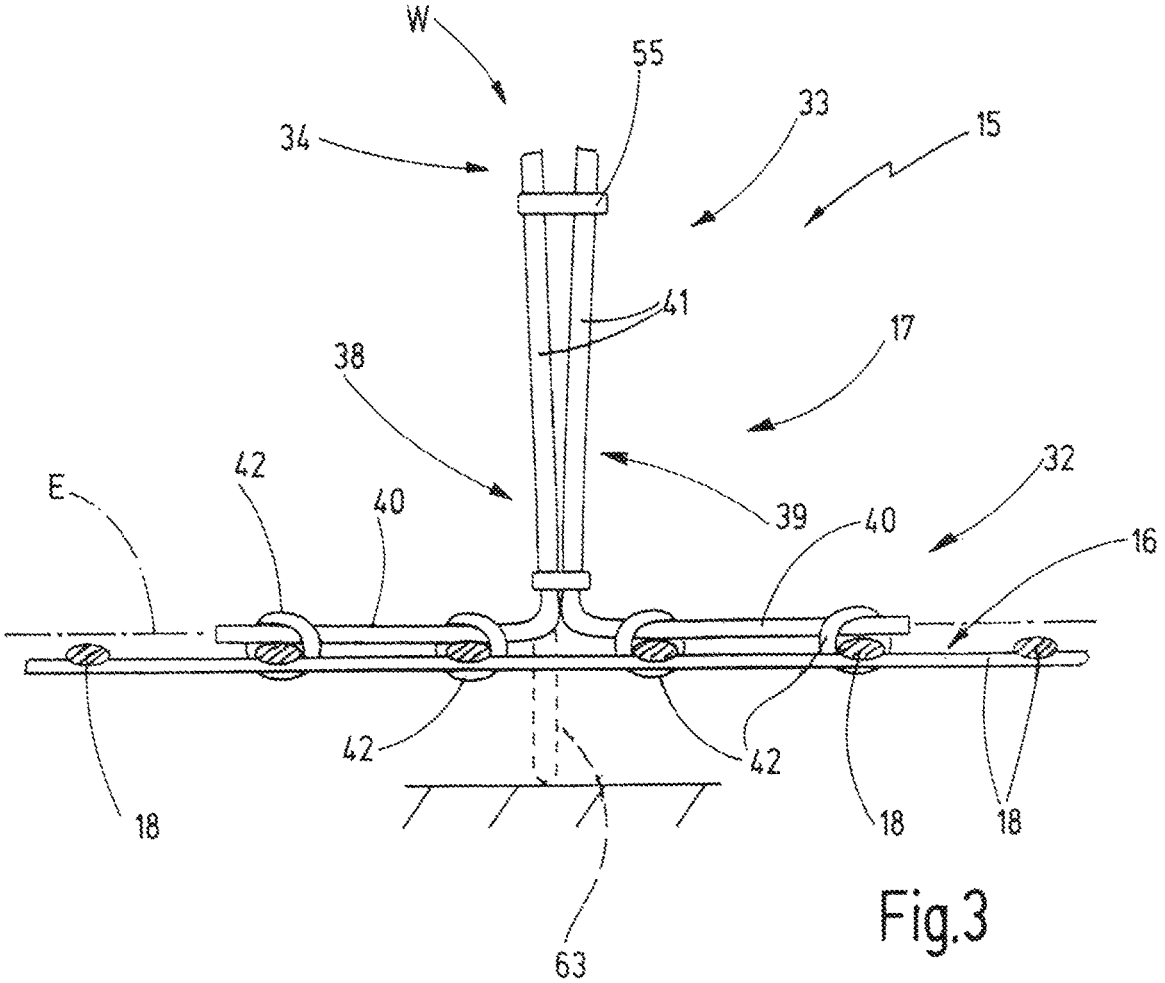
FIG. 3 shows the embodiment of the reinforcement arrangement according to FIGS. 1 and 2 in a schematic side view, wherein the holding section of the holding anchor unit assumes a function position.

The two foot parts 40 form the foot section 32 in the embodiment according to FIGS. 1-4 and 9. The foot parts 40 are attached at the reinforcement body 16 by separate attachment means 42. A thread, band or another flexible element can be used as attachment means 42. In the embodiment each attachment means 42 comprises a cable tie. As schematically illustrated in FIGS. 1 and 3, each foot part 40 is attached at the reinforcement body 16 by means of two attachment means 42.

Additionally, the first holding anchor 38 and the second holding anchor 39 can be connected with each other in the transition region between the respective foot part 40 and holding part 41 by a connection means 43. The connection means 43 can be embodied comparable to the attachment means 42 and is formed in one embodiment by a cable tie. Instead of a cable tie any other means can be used for the attachment means 42 and the connection means 43 that can form a loop, for example.

The attachment means 42 and/or the connection means 43 is preferably free of metallic components. The attachment means 42 and/or the connection means 43 consist preferably of synthetic material.

Figure 6:
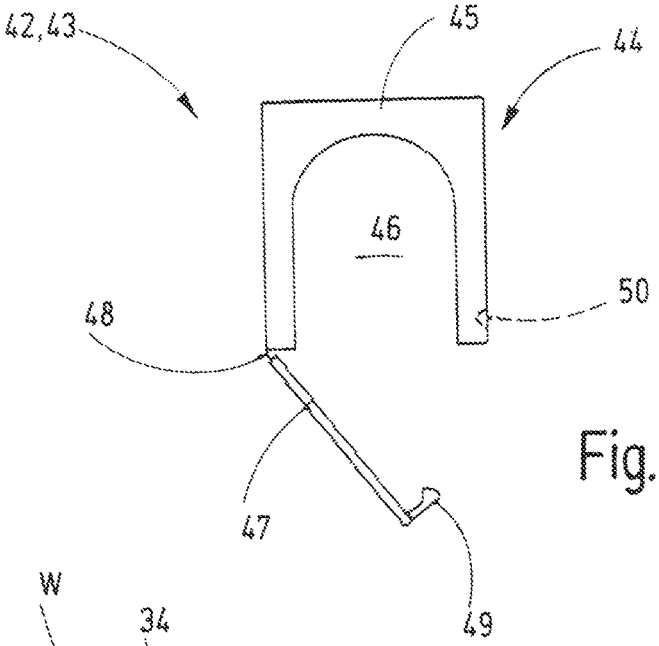
FIG. 6 shows a schematic basic illustration of an embodiment of an alternative attachment means for attaching a holding anchor unit at the reinforcement body.

FIG. 6 schematically illustrates another embodiment of an attachment means 42 and a connection means 43 respectively, having the form of a clip 44. The clip 44 has an approximately U-shaped bracket 45 with two substantially parallel legs that surrounds an inner region 46. The inner region 46 is open to one side and can be closed at this open side by a closing part 47. The closing part 47 can be embodied as an individual part that can be connected with the bracket 45. In the embodiment the closing part 47 is pivotably attached at one leg of the bracket 45 by a film hinge 48 and is connectable with the respective other leg of the bracket 45 by a latch means 49, that cooperates with a latch counter means 50 at the associated leg of the bracket 45. In the closed position the bracket 45 and the closing part 47 create a ring-like closed shape and can enclose and thus connect a foot part 40 and at least one reinforcement element 18 or the two holding anchors 38, 39.

In this context it is indicated again that the attachment means 42 and/or the connection means 43 can be embodied in various ways.

Starting from the bend or kink location that forms the transition between the holding part 41 and the foot part 40 of a holding anchor 38 or 39, the foot part 40 and the holding part 41 extend particularly linearly. The two foot parts 40 of a common holding anchor unit 17 are arranged in the same planar or curved plane E (FIGS. 2 and 3) in the embodiment. This plane E is defined by the shape of the portion of the reinforcement body 16 at which the foot parts 40 are attached. This plan E extends planarly (FIG. 3), if this portion of the reinforcement body 16 is also orientated planarly without action from outside. If the reinforcement body 16 is rolled up for storage (FIG. 2), the plane E can be curved according to the curvature of the reinforcement body 16.

As illustrated in FIG. 1, the foot parts 40 of the same holding anchor unit 17 include an angle α that is smaller than 180 degrees and is preferably larger than 90 degrees.

Each foot part 40 extends substantially along a longitudinal axis, wherein the foot part 40 of the first holding anchor 38 defines a first pivot axis S1 and the foot part 40 of the second holding anchor 39 defines a second pivot axis S2. The holding part 41 of the first holding anchor 38 is pivotable around the first pivot axis S1 and the holding part 41 of the second holding anchor 39 is pivotable around the second pivot axis S2 between the storage position A and the function position W. In doing so, the respective holding part 41 can be arranged against or next to the reinforcement body (storage position A) or can extend obliquely or orthogonally away from the reinforcement body 16 (function position W).

The rising of the holding section 33 of a holding anchor unit 17 or the two holding parts 41 from the storage position A into the function position W can be executed manually or self-acting. In the illustrated embodiments the at least one holding anchor unit 17 is configured to bring itself into the function position W in a self-acting manner, if the reinforcement body 16 occupies its position that it should have in the construction material body 21 that is to be produced. For example, the reinforcement body 16, embodied as reinforcement grid, can be rolled up for storage, as it is schematically shown in FIG. 2. Due to the elastic deformation of the reinforcement element 18, the holding parts 41 or the holding section 33 is maintained in the storage position A. If the reinforcement grid is rolled out flatly (FIGS. 3 and 4), the holding section 33 or the two holding parts 41 move into the function position W in a self-acting manner.

To achieve this self-acting rise in the function position W, a pretensioning force F and/or a pretensioning torque M acts onto the holding section 33 or the holding parts 41, that urges the holding parts 41 or the holding section 33 in the direction toward the function position W.

In the first embodiment according to FIGS. 1-4 and 9, each holding anchor unit 17 comprises a pretensioning means 55. The pretensioning means 55 is, for example formed by an elastic band that circumscribes the two holding parts 41 and is preferably arranged adjacent to the free end 34 of the holding section 33. Instead of the band another elastically deformable body can be used.

The pretensioning means 55 creates a pretensioning force F between the holding parts 41 that urge the holding part 41 in direction toward the respective other holding part 41 of the same holding anchor unit 17 (FIG. 1). Because the two foot parts 40 include an angle α smaller than 180 degrees, the free ends of the holding parts 41 have a greater distance to each other in the storage position A than in the function position W. The pretensioning force, with which the holding parts 41 are urged toward each other, is in the storage position A larger than in the function position W, due to the greater elastic deformation of the pretensioning means 55. For this reason the two holding parts 41 of the holding anchors 38, 39 tend to move into the function position W and a pretensioning torque M is created around the respective pivot axis S1, S2. If the reinforcement body 16 is brought into a position within a form work 56, that the reinforcement body 16 shall occupy in the future construction material body 21, the pretensioning force F or the pretensioning torque M moves the holding section 33 of each holding anchor unit 17 into the function position W. By means of extraneous forces, for example due to rolling up of the reinforcement body 16 for storage (compare FIG. 2), a movement from the storage position A into the function position W can be blocked due to elastic deformation of the holding anchor unit 17 or the two holding anchors 38, 39. This is also true, if a plurality of reinforcement arrangements 15 is stacked up on each other, such that due to the weight of a reinforcement arrangement 15 arranged on top, the holding anchor unit 17 of the reinforcement arrangement 15 arranged below are hindered in moving their holding sections 33 from the storage position A into the function position W.

Figure 7:
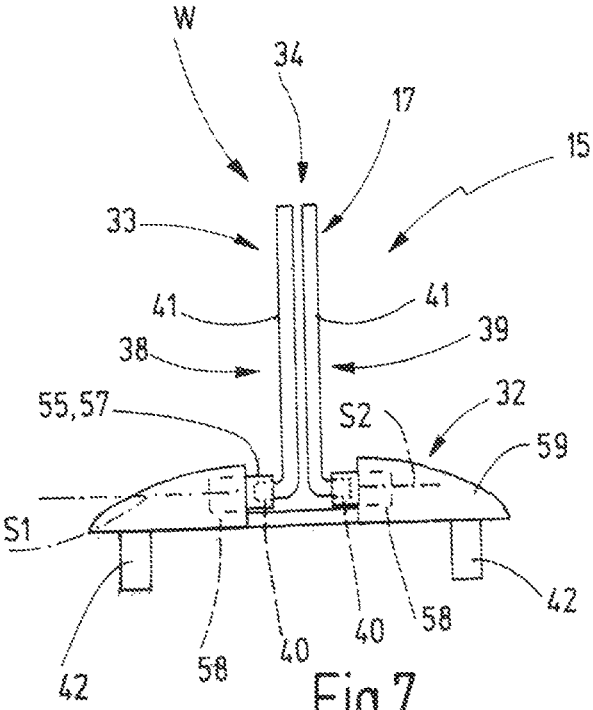
FIG. 7 shows a schematic basic illustration of another embodiment of a holding anchor unit.
Figure 8:
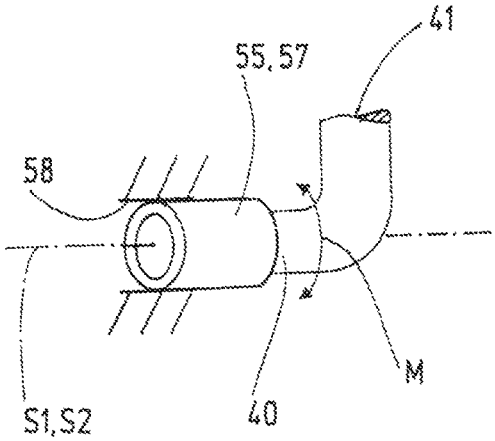
FIG. 8 shows a basic illustration of creating a pretensioning force that urges the holding section of the holding anchor unit according to FIG. 7 in the function position.

In FIGS. 7 and 8 a second embodiment of the holding anchor unit 17 is illustrated. The holding anchor unit 17 comprises similarly to the first embodiment two holding anchors 38, 39, each having a holding part 41 and a foot part 40. In the embodiment according to FIG. 7, the foot parts 40 extend substantially in opposite directions away from each other and thus include within the common plane an angle $\alpha$ of about 180 degrees.

In this embodiment an elastically deformable, twistable sleeve 57 is used as pretensioning means 55 that connects the foot part 40 of each holding anchor 38, 39 with a bearing recess in a bearing body 59. In this embodiment the bearing body 59 forms part of the foot section 32 and is connectable with the reinforcement body 16 by one or more attachment means 42.

In the function position W the sleeve 57 is not twisted and the holding part 41 extends starting from the foot part 40 in an orientation away from the bearing body 59 that it should occupy in the function position W, for example obliquely or orthogonally from the reinforcement body 16 toward the free end 34. If the holding part 41 is pivoted out of the function position W about approx. 90 degrees around the respective pivot axis S1, S2, the respective sleeve 57 is twisted and creates a pretensioning torque M around the respective pivot axis holding anchor 38 or 39 is urged in direction toward the function position W, due to the twist torque M and occupies the function position W, if no extraneous force is applied. In this embodiment it is also possible to pivot the holding parts 41 in both directions around the respective pivot axis S1 or S2, such that two storage positions A can be achieved in this embodiment so to say.

In a further modification the bearing body 59 can also be omitted and the sleeve 57 can be directly attached at the reinforcement body 16 by an attachment means 42.

Figure 4:
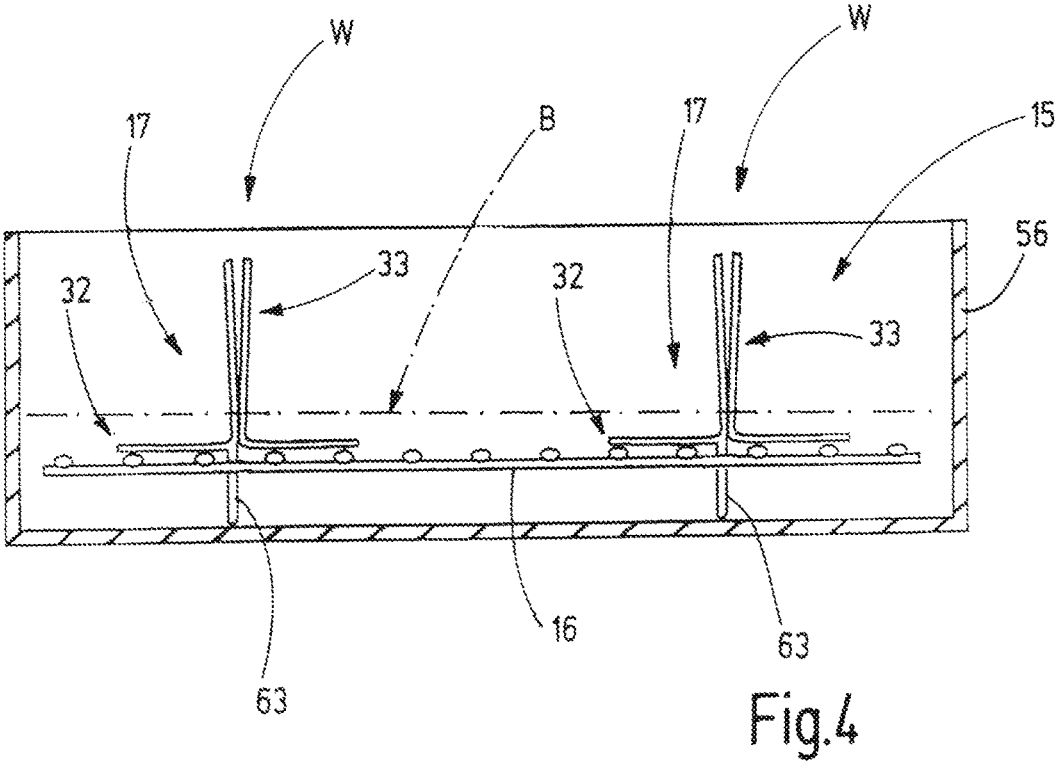
FIG. 4 shows an embodiment of a reinforcement arrangement with a plurality of holding anchor units, the holding sections thereof are in the function position, wherein the reinforcement arrangement is arranged in a formwork for producing a construction material body.
Figure 5:
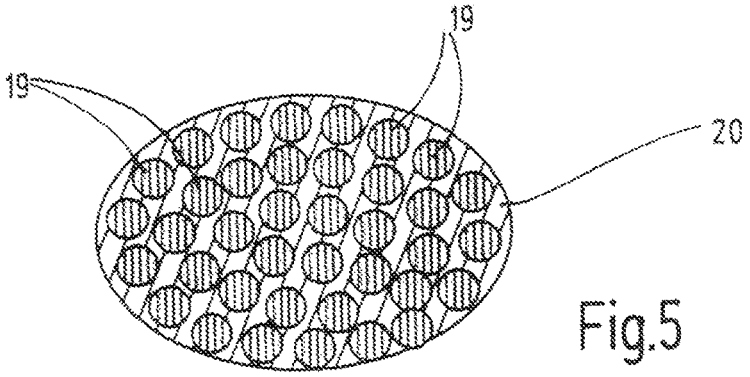
FIG. 5 shows a cross-section through a reinforcement element of the reinforcement body according to the section line V-V in FIG. 1.

By means of FIGS. 3 and 4 another optional embodiment possibility of the holding anchor unit 17 is illustrated. Each holding anchor unit 17 can comprise a spacer 63 that extends in the function position W obliquely or orthogonally away from the foot section 32, preferably in a direction opposite to the holding section 33. As schematically illustrated, an extension can be formed in the transition area between the foot part 40 and the holding part 41 at at least one of the two holding anchors 38, 39, wherein the extension extends substantially opposite to the holding part 41 and forms the spacer 63. The spacer 63 is thus pivoted during movement of the holding part 41 between the storage position A and the function position W as well and thus abuts particularly flatly against the reinforcement body 16 in the storage position A comparable to the holding part 41. In the function position W the spacer 63 extends transverse away from the reinforcement body 16 and can be used to place the reinforcement arrangement 15 in the formwork 56. By means of at least three of such spacers 63, the reinforcement arrangement 15 can be positioned inside a formwork 56.

By using an embodiment of the reinforcement arrangement 15, a construction material body 21 can be produced as follows:

The reinforcement arrangement 15 is arranged inside the formwork 56 in a way that the reinforcement body 16 occupies the position that it shall have in the future construction material body 21. In doing so, the holding sections 33 of the holding anchor units 17 are automatically moved into their function position W. The reinforcement arrangement 15 can be supported at the formwork 56 by spacers 63 or alternatively separate spacers can be arranged between the reinforcement arrangement 15 and the formwork 56. The reinforcement arrangement 15 can also be positioned in the inner space of the formwork 56 by other positioning means and may do without spacers 63 that are supported inside at the formwork 56.

If the reinforcement arrangement 15 is positioned inside the formwork 56, a curable construction material B is filled in. The pouring is executed in a way, such that the construction material B forms the first construction material layer 23 that covers the reinforcement body 16 and the foot sections 32 of the holding anchor units 17. At least a portion adjoining the free end 34 of each holding section 33 of each holding anchor unit 17 extends out of the construction material B.

In the still not cured condition of the construction material B of the first construction material layer 23 an intermediate layer is arranged on the first construction material layer 23, for example by arranging of a plurality of bodies 25 that can be embodied, for example as insulation bodies. At the abutment locations between two adjacent insulation bodies 25, the holding sections 33 of the holding anchor units 17 pass by and extend over the intermediate layer 24. Onto this intermediate layer 24 another second construction material layer 27 can be applied subsequently and cured. The second construction material layer 27 forms an outer layer 26 of the construction material body 21 that can also be named as facing. By the holding anchor unit 17 and particularly the holding sections 33 the second construction material layer 27 is connected with the first construction material layer 23 that forms a supporting layer 22. Loads and forces that act on the second construction material layer 27 can thus be supported by the supporting layer 22 over the holding anchor unit 17.

The positioning of the holding anchor unit 17 at the reinforcement body 16 can be executed such that a distance between the holding sections 33 corresponds to a predefined pattern, such that the bodies 25 can be placed in between without the need to cut holes or recesses into the bodies 25. The bodies 25 are usually elastically and/or plastically deformable in a way that the holding sections 33 can pass through the abutment location or connection location of two adjacent bodies 25 without problems, as it is illustrated schematically in FIG. 10. In this context it is indicated that the illustration in FIG. 10 is not true to scale and the intended purpose is only illustration. The diameter or the cross-sections of the holding sections 33 or the holding parts 41 is regularly sufficiently small that two adjacent bodies 25 directly abut against each other adjacent to the holding section 33 or can be connected with each other by means of an adhesive layer.

The invention refers to a reinforcement arrangement 15 and a method for producing a construction material body 21 using the reinforcement arrangement 15. The reinforcement arrangement 15 comprises a reinforcement body 16 and at least one holding anchor unit 17. Each holding anchor unit 17 is arranged or attached at the reinforcement body 16 by a foot section 32. A holding section 33 adjoining the foot section 32 is moveable between a storage position A and a function position W. In the storage position A the holding section 33 extends directly adjacent along the reinforcement body 16 and can abut at one or more locations at the reinforcement body 16. In the function position W a distance of a free end 34 of the holding section 33 opposite the foot section 32 is larger than in the storage position A. The holding section 33 can be moved manually or self-acting from the storage position A into the function position W. Preferably the whole reinforcement arrangement 15 is free of metallic components. The reinforcement body 16 and/or the holding section 33 and/or the foot section 32 are preferably embodied as textile-reinforced elements.

PARTS LIST

15 reinforcement arrangement
16 reinforcement body
17 holding anchor unit
18 reinforcement element
19 fiber
20 matrix
21 construction material body
22 supporting layer
23 first construction material layer
24 intermediate layer
25 body of the intermediate layer
26 outer layer
27 second construction material layer
32 foot section
33 holding section
34 free end of the holding section
38 first holding anchor
39 second holding anchor
40 foot part
41 holding part
42 attachment means
43 connection means
44 clip
45 bracket
46 inner region of the bracket
47 closing part
48 film hinge
49 latch means
50 latch counter means
52 pretensioning means
56 formwork
57 sleeve
58 bearing recess
59 bearing body
60 spacer
α bend angle
α angle
A storage position
B construction material
F pretensioning force
M pretensioning torque
W function position

The invention claimed is:

1. A reinforcement arrangement (15), comprising:

a reinforcement body (16) comprising reinforcement elements (18) that cross each other, at least one holding anchor unit (17) comprising a foot section (32) that is arranged at the reinforcement body (16) and having a holding section (33) adjoining the foot section (32), wherein the holding section (33) is moveable between a function position (W) and a storage position (A) and wherein in the storage position (A) the holding section (33) extends along the reinforcement body (16) and in the function position (W) the holding section (33) extends obliquely or orthogonally away from the reinforcement body (16);

wherein when the at least one holding anchor unit (17) is in the storage position (A), it is subject to one or both of a pretensioning force (F) and a pretensioning torque (M) such that the holding section (33) is urged toward the function position (W) such that the at least one holding anchor unit will shift from the storage position (A) to the function position (W) absent an external force on the at least one holding anchor unit to prevent such shifting;

wherein in the function position (W) the holding section (33) extends obliquely or orthogonally away from a plane defined by a section of the reinforcement body 16 at which the holding anchor unit (17) is arranged or attached via the foot section (32).

2. The reinforcement arrangement according to claim 1, wherein each reinforcement element (18) comprises at least one fiber bundle that is embedded in a matrix (20).

3. The reinforcement arrangement according to claim 1, wherein individual ones of the at least one holding anchor unit (17) has two holding anchors (38, 39) having a foot part (40) and a holding part (41) that extends orthogonally or obliquely relative to the foot part (40).

4. The reinforcement arrangement according to claim 3, wherein each holding anchor (38, 39) is formed integrally.

5. The reinforcement arrangement according to claim 3, wherein the holding anchors (38, 39) comprises at least one fiber bundle that is embedded in a matrix (20).

6. The reinforcement arrangement according to claim 3, wherein the holding part (41) is pivotable about a pivot axis (S1, S2) that is at least partly defined by an extension direction of the foot part (40) of the same holding anchor (38, 39).

7. The reinforcement arrangement according to claim 3, wherein the foot parts (40) of the holding anchors (38, 39) of the same holding anchor unit (17) extend in a common plane.

8. The reinforcement arrangement according to claim 3, wherein the foot parts (40) of the holding anchors (38, 39) of the same holding anchor unit (17) extend at an angle (a) of less than 180° with respect to the holding part (41) of the same holding anchor (38, 39).

9. The reinforcement arrangement according to claim 3, wherein the foot parts (40) of the holding anchors (38, 39) of the same holding anchor unit (17) extend at an angle (a) of at least 90° with respect to the holding part (41) of the same holding anchor (38, 39).

10. The reinforcement arrangement according to claim 1, wherein the holding anchor unit (17) comprises a pretensioner (55) that applies at least one of a pretensioning force (F) and a pretensioning torque (M) on the holding anchors (38, 39).

11. The reinforcement arrangement according to claim 10 wherein the pretensioner (55) is elastically deformable.

12. The reinforcement arrangement according to claim 1, wherein a free end of the at least one holding section is located further from the reinforcement body when the at least one holding section is in the function position than when the at least one holding section is in the storage position.

13. A reinforcement arrangement (15), comprising:

a reinforcement body (16) comprising reinforcement elements (18) that cross each other, at least one holding anchor unit (17) comprising a foot section (32) that is arranged at the reinforcement body (16) and having a holding section (33) adjoining the foot section (32);

wherein the holding section (33) is moveable between a function position (W) and a storage position (A) and wherein in the storage position (A) the holding section (33) extends along the reinforcement body (16) and in the function position (W) the holding section (33) extends obliquely or orthogonally away from the reinforcement body (16);

wherein when the at least one holding anchor unit (17) is in the storage position (A), it is subject to one or both of a pretensioning force (F) and a pretensioning torque (M) such that the holding section (33) is urged toward the function position (W) such that the at least one holding anchor unit will shift from the storage position (A) to the function position (W) absent an external force on the at least one holding anchor unit to prevent such shifting;

wherein individual ones of the at least one holding anchor unit (17) have two holding anchors (38, 39) having a foot part (40) and a holding part (41) that extends orthogonally or obliquely relative to the foot part (40);

wherein the holding anchors (38, 39) comprise at least one fiber bundle that is embedded in a matrix (20).

* * * * *